US006175711B1

(12) United States Patent
Yoshino et al.

(10) Patent No.: US 6,175,711 B1
(45) Date of Patent: Jan. 16, 2001

(54) IMAGE FORMING APPARATUS HAVING A TONER DIFFUSER

(75) Inventors: Naoto Yoshino; Tatsuya Soga; Naoto Nishi; Yukio Hayashi; Takashi Kawabata; Shuji Iseki; Keiji Yamamoto; Nobuyoshi Komatsu; Norio Hokari, all of Ebina (JP)

(73) Assignee: Fuji Xerox Co., Ltd., Tokyo (JP)

( * ) Notice: Under 35 U.S.C. 154(b), the term of this patent shall be extended for 0 days.

(21) Appl. No.: 09/388,385

(22) Filed: Sep. 1, 1999

(30) Foreign Application Priority Data

Oct. 16, 1998 (JP) ..... 10-294860

(51) Int. Cl.[7] ..... G03G 15/16
(52) U.S. Cl. ..... 399/297; 399/313
(58) Field of Search ..... 399/297, 313, 399/314, 318

(56) References Cited

U.S. PATENT DOCUMENTS 3,781,105 * 12/1973 Meagher ..... 399/314
3,901,186 * 8/1975 Hoffman et al. ..... 399/318 X
5,559,590 * 9/1996 Arai et al. ..... 399/314
5,812,919 * 9/1998 Takano et al. ..... 399/313 X
5,966,564 * 10/1999 Kizaki et al. ..... 399/297 X

FOREIGN PATENT DOCUMENTS 60-107054 * 6/1985 (JP) .
8-328401 12/1996 (JP) .
9-218623 8/1997 (JP) .

* cited by examiner

*Primary Examiner*—Susan S. Y. Lee
(74) *Attorney, Agent, or Firm*—Oliff & Berridge, PLC

(57) ABSTRACT

The image forming apparatus is capable of preventing contamination of the rear surface of paper while minimizing the deterioration of the surface of the transfer roll. The image forming apparatus has an intermediate transfer belt for carrying a toner image visualized by a toner, a transfer roll pressed against the intermediate transfer belt, and a cleaning brush that is rotatable in contact with the transfer roll. This transfer roll acts to transfer the toner image carried on the belt to paper. The cleaning brush makes contact with the transfer roll to stir the toner adhering to the transfer roll.

12 Claims, 4 Drawing Sheets

IMAGE FORMING APPARATUS HAVING A TONER DIFFUSER

BACKGROUND OF THE INVENTION

1. Field of the Invention

The present invention relates to an image forming apparatus for creating an image using an image-carrying belt.

2. Related Art

Some electrophotographic image forming apparatuses such as copiers and printers use belt-like image carriers (hereinafter referred to as image-carrying belts) to create images.

In this kind of image forming apparatus, latent electrostatic images are created on a photoconductor and developed with toners, thus visualizing the toner images. The toner images are then transferred to an image-carrying belt. Subsequently, all the toner images on the image-carrying belt are transferred to paper (recording medium) at a time. This method is normally known as the "intermediate transfer method", and the image-carrying belt is termed the "intermediate transfer belt".

In a full-color copier or the like making use of the aforementioned transfer method, toner images of plural colors (e.g., yellow (Y), magenta (M), cyan (C), and black (K)) are superimposed in turn on the image-carrying belt and transferred, thus forming one color image. At this time, if the toner images of the various colors are not coincident in transfer position, or if the concentrations of the toner images deviate from specified concentrations, deviations from the correct colors and nonuniformities of colors take place. Accordingly, where a color image is created, an ineffective region separate from the normal toner image formation region from which toner images are transferred to the paper is formed on the image-carrying belt. Patch images (referred to as the process control patch images) for position registration of toner images and for control of the concentrations are formed. Various control parameters are appropriately set or modified according to the results of reading of the patch images. In this way, the color image is free of color shifts and color nonuniformities.

A primary transfer position where toner images are transferred from the photoconductor to the image-carrying belt and a secondary transfer position where toner images are transferred from the image-carrying belt to the paper are established in the path in which the image-carrying belt moves. Transfer rolls or transfer means such as transfer belts are mounted in these two transfer positions. The transfer roll placed in the primary transfer position is pressed against the surface of the photoconductor via an image-carrying belt. The transfer roll placed in the secondary transfer position is held so as to be capable of being brought into and out of contact with a backup roll that supports the image-carrying belt from inside.

In the secondary transfer position described above, the transfer roll is pressed against the front side (to which toner images are transferred) of the image-carrying belt held by the backup roll. Under this condition, a transfer bias voltage is applied to one or both of the backup roll and the transfer roll. Thus, the toner images are transferred from the image-carrying belt to the front surface of the paper.

The process control patches formed in the ineffective regions of the image-carrying belt directly touch the transfer belt without via the paper and so the toners forming the process control patches adhere to the transfer roll from the image-carrying belt. On the other hand, when the paper is nipped between the image-carrying belt and the transfer roll, the transfer roll is pressed against the rear surface of the paper. Therefore, the toner adhering to the transfer roll as described above is again transferred to the rear surface of the paper. This contaminates the rear surface of the paper. Especially, in the case of process control patches, their sharp edges are accentuated. If they are transferred to the rear surface of the paper as they are, the contamination becomes worse.

Besides the process control patches, if the toner images carried on the image-carrying belt differ in size from the paper to which the toner images should be transferred, the toners on the belt adhere to the transfer roll. This may contaminate the rear surface of the paper. Furthermore, toners adhering to a component other than the image-carrying belt such as an image carrier that carries images on the photoconductor may adhere to the transfer roll, thus contaminating the rear surface of the paper.

A countermeasure against these problems is disclosed in Japanese Unexamined Patent Publication No. 328401/1996. In particular, a bias voltage that is opposite in polarity to the transfer bias voltage applied in transferring toner images from an image-carrying belt to paper (hereinafter referred to as a reverse bias) is applied to the transfer roll, thus cleansing the toner adhering to the transfer roll.

Japanese Unexamined Patent Publication No. 218623/1997 discloses a technique for removing toners from the surface of a transfer roll by pushing a cleaning blade against the transfer roll.

The techniques disclosed in these two Japanese Patent Publications have the following problems. First, in the technique disclosed in Japanese Unexamined Patent Publication No. 328401/1996, the cleaning capability is affected by paper jams and environmental variations such as temperature and humidity variations. Consequently, it has been difficult to completely cleanse the toners simply by applying a reverse bias to the transfer roll.

The technique disclosed in the above-cited Japanese Unexamined Patent Publication No. 218623/1997 has the following problems. (1) Since the blade is pushed against the transfer roll, its surface is deteriorated, thus shortening the life of the transfer roll. (2) The surface of the transfer roll is coated with a fluorocarbon or the like to improve the ability to peel off from the paper and the cleanability. This coating is gradually peeled by the blade. Therefore, the paper is wound around the transfer roll. Hence, jams tend to occur. (3) It is necessary to install a new large-sized recovery box for recovering toner removed by the blade. (4) The surface of the transfer roll including the coating wears down. Also, the blade itself wears down. In consequence, the cleaning effect of the blade deteriorates.

SUMMARY OF THE INVENTION

The present invention has been made to solve the foregoing problems.

It is an object of the present invention to provide an image forming apparatus capable of preventing the rear surface of paper from being contaminated while minimizing deterioration of the surface of the transfer roll.

An image forming apparatus in accordance with the present invention comprises an image carrier for carrying toner images visualized by toners, transfer means in contact with the image carrier, and toner diffusion means. The transfer means acts to transfer toner images carried by the image carrier to a recording medium. The toner diffusion means makes contact with the image carrier to thereby stir the toners adhering to the transfer roll.

In the image forming apparatus constructed as described above, the toner from the image carrier that adheres to the transfer means is stirred by the toner diffusion means. This diffuses the toners on the transfer means over a wide area, reducing the concentration. Therefore, if a toner forming a process control patch that causes a conspicuous contamination of the rear surface of the recording medium adheres to the transfer roll, the sharp edges are blurred by the diffusion of the toner. As a result, the edges are erased. If the transfer roll is pressed against the rear surface of the recording medium, the toner adhering to the transfer roll is prevented from appearing as a clearly visible contamination on the rear surface of the recording medium. Unlike the prior art cleaning method consisting of peeling the toner by pushing the blade against the roll, the toner adhering to the transfer means is stirred. The contamination on the rear surface of the recording medium is reduced to a level that cannot be observed visually. Hence, the transfer means is prevented from being damaged heavily.

Other objects and features of the invention will appear in the course of the description thereof, which follows.

DESCRIPTION OF THE PREFERRED EMBODIMENTS

The preferred embodiments of the present invention are hereinafter described by referring to the accompanying drawings.

Figure 1:
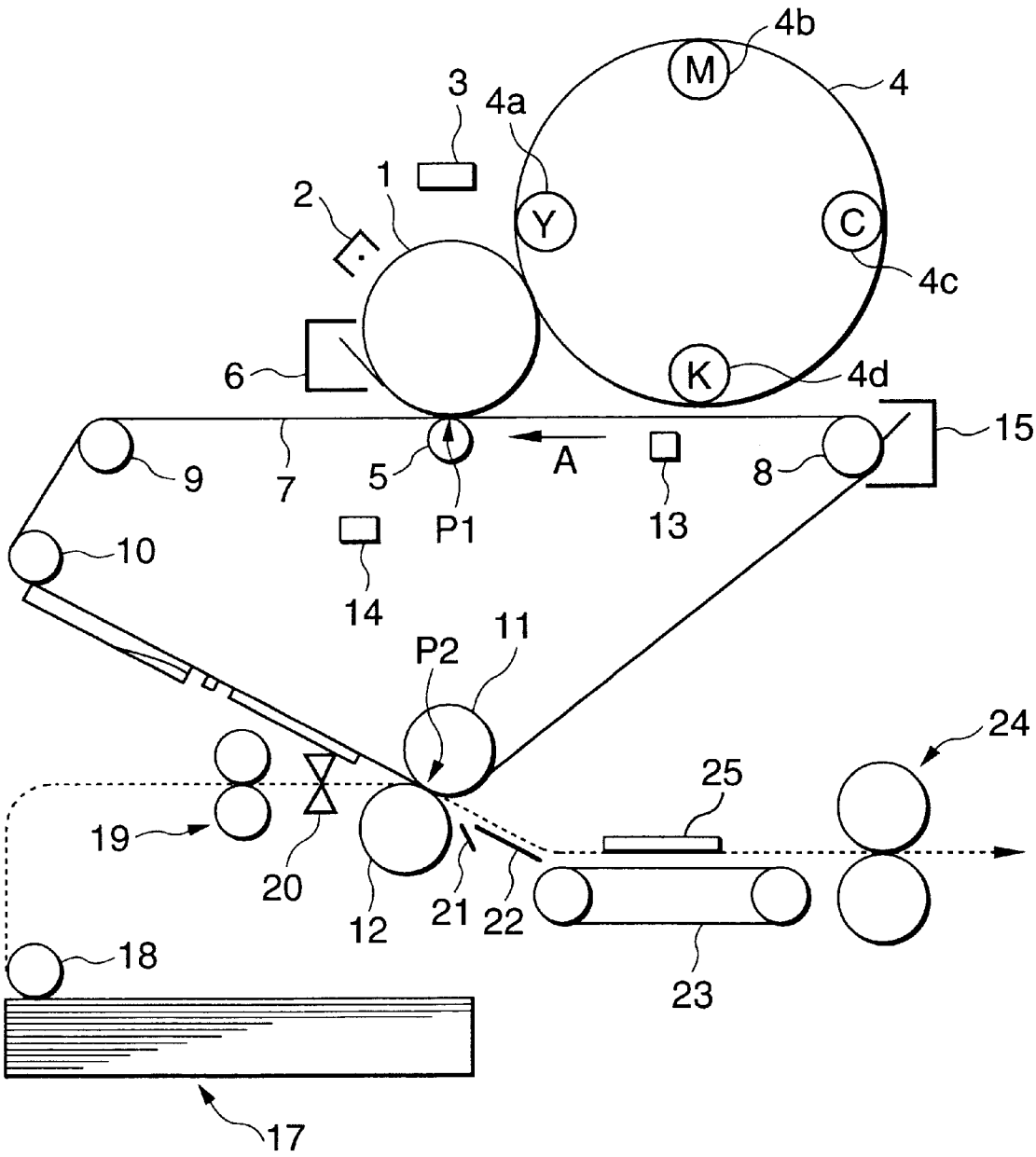
FIG. 1 is a schematic side elevation of an image forming apparatus in accordance with the present invention.

FIG. 1 is a schematic side elevation of an image forming apparatus embodying the concept of the present invention. In FIG. 1, a charger 2, an exposure unit 3, a rotary developing system 4, an intermediate transfer roll 5, and a photoconductor cleaner 6 are mounted around a photoconductor (PC) drum 1. The developing system 4 includes developing units 4*a*, 4*b*, 4*c*, and 4*d* corresponding to various colors of yellow (Y), magenta (M), cyan (C), and black (K), respectively.

An endless intermediate transfer belt 7 that is an image-carrying belt is stretched under the photoconductor drum 1. This belt 7 is supported by a drive roll 8, a follower roll 9, a tension roll 10, and a backup roll 11. The drive roll 8 is rotated by a driving force from an electric motor (not shown). In response to this rotation, the intermediate transfer belt 7 moves in the direction indicated by the arrow A.

The intermediate transfer belt 7 is made of a material consisting of polyimide, polycarbonate, polyester, polypropylene, other resin, or various kinds of rubber to which an appropriate amount of antistatic agent such as carbon black is added. The volume resistivity of the belt 7 is $10^6$ to $10^{10}\Omega\cdot$cm. The thickness is set to about 0.1 mm.

A primary transfer position P1 and a secondary transfer position P2 are established in the path of the intermediate transfer belt 7. In the primary transfer position P1, the intermediate transfer belt 7 is passed between the photoconductor drum 1 and the intermediate transfer roll 5. In the secondary transfer position P2, a transfer roll 12 is located opposite to the backup roll 11, and the intermediate transfer belt 7 is passed between the transfer roll 12 and the backup roll 11.

The backup roll 11 is made of a tube of EPDM (ethylene propylene rubber)/NBR (acrilonitrile butadiene rubber) blend rubber having the surface dispersed with carbon, for example. The inside is made of EPDM. The surface resistivity of the backup roll 11 is $10^7$ to $10^{10}$ $\Omega/\square$. The diameter of the roll is set to 28 mm. The hardness is 65° (Asker C).

On the other hand, the transfer roll 12 is made of a tube of urethane rubber having a surface dispersed with carbon. The inside is made of urethane rubber foam in which carbon is dispersed. The surface of the transfer roll 12 is coated with a fluorocarbon. The volume resistivity is $10^3$ to $10^{10}$ $\Omega\cdot$cm. The diameter of the roll is 28 mm. The hardness is 20° (Asker C), for example.

A position detection sensor 13 and a humidity sensor 14 are located inside the intermediate transfer belt 7. The position detection sensor 13 is used to detect the position of the intermediate transfer belt 7 in the direction of movement of the belt. The humidity sensor 14 is used to detect environmental variations. A belt cleaner 15 is mounted near the drive roll 8 to remove the toner left on the intermediate transfer belt 7.

Paper that is a recording medium is placed in position on a tray 17. A paper transport path (indicated by the broken lines) extends from the tray 17 to the secondary transfer position P2 where the paper is nipped between the backup roll 11 and the transfer roll 12. A feed roll 18, a registration roll 19, and a paper detection sensor 20 are located in this order in a downstream direction. The feed roll 18 takes sheets of paper from the tray 17 one by one and sends them to the transport path. The registration roll 19 sends the arrived sheet to the secondary transfer position P2 at given timing. The paper detection sensor 20 detects the timing of passage of the paper driven by the registration roll 19. An electrode member 21, a guide member 22, a paper transport belt 23, and a fuser 24 are placed in this order along the paper transport path on the downstream side of the secondary transfer position P2.

The operation of the image forming apparatus constructed described thus far is next described. When the photoconductor drum 1 is rotating, the charger 2 uniformly charges the surface of the photoconductor drum 1. The exposure unit 3 emits a laser beam toward the drum 1. Consequently, a latent electrostatic image corresponding to image information is created on the surface of the photoconductor drum 1.

If the latent electrostatic image formed on the PC drum 1 corresponds to yellow image information, this latent image is developed by the developing unit 4*a* containing yellow (Y) toner. A toner image visualized by the yellow toner is formed on the PC drum 1, carried on the PC drum 1, and sent to the primary transfer position P1.

In the primary transfer position P1, the intermediate transfer belt 7 is pressed against the surface of the PC drum 1 by the intermediate transfer roll 5. Under this condition, the PC drum 1 and the belt 7 rotate in synchronism. When the toner image carried on the PC drum 1 arrives at the primary transfer position, a bias voltage that is opposite in polarity to the charge given to the toner is applied to the intermediate transfer roll 5. The resultant electrostatic attraction cooperates with the pressurizing action of the intermediate transfer roll 5 to transfer the toner image on the belt 7 to the intermediate transfer belt 7.

Then, the yellow toner image transferred to the intermediate transfer belt 7 is sent back to the primary transfer position P1 via the follower roll 9, tension roll 10, backup roll 11, and drive roll 8. During this period, the transfer roll 12 is kept away from the backup roll 11 and from the intermediate transfer belt 7.

The surface of the PC drum 1 is cleaned by the drum cleaner 6. A latent electrostatic image is again created on the surface of the photoconductor drum 1 by a procedure similar to the aforementioned procedure. However, the latent electrostatic image created at this time corresponds to a color other than the aforementioned yellow, e.g., magenta (M). The developing system 4 is rotated to bring the developing unit 4*b* into a position opposite to the PC drum 1. The latent electrostatic image on the PC drum 1 is developed by the magenta toner.

The magenta toner image visualized in this way is carried on the PC drum 1 and sent to the primary transfer position P1. This toner image is superimposed on the yellow toner image already present on the intermediate transfer belt 7 and transferred.

Subsequently, similar operations are carried out to transfer toner images of cyan (C) and black (K) to the intermediate transfer belt 7 in the primary transfer position P1 in turn. As a result, the toner images of the four colors (Y, M, C, K) are superimposed on the intermediate transfer belt 7. Thus, a full-color toner image (hereinafter referred to as a color toner image) is obtained.

Where a monochrome (single color) image such as a black-and-white image is created, a toner image transferred to the intermediate transfer belt 7 is immediately transferred to the paper in the secondary transfer position P2.

Then, the color toner image on the intermediate transfer belt 7 is sent to the secondary transfer position P2 facing the paper transport path. Prior to arrival of the color toner image at the secondary transfer position P2, the transfer roll 12 moves toward the backup roll 11. The belt 7 is held between this backup roll 11 and the transfer roll 12. Sheets of paper are delivered from the tray 17 by the feed roll 18. The sheets are conveyed to the secondary transfer position P2 at given timing by the registration roll 19.

In the secondary transfer position P2, a transfer bias voltage is applied to one or both of the backup roll 11 and the transfer roll 12. Thus, the color toner image on the intermediate transfer belt 7 is electrostatically transferred to the paper 25. The paper 25 having the color toner image transferred thereto is separated from the intermediate transfer belt 7. Then, the paper is sent into the fuser 24 via the electrode member 21, guide plate 22, and paper transport belt 23. In the fuser 24, the color toner image is finally fixed.

As described previously in the column of the prior art technique, if a process control patch is formed on the intermediate transfer belt 7, or if the toner image on the intermediate transfer belt 7 differs in size from the paper 25, the toner on the belt 7 adheres to the transfer roll 12 in the secondary transfer position P2, the roll 12 being pressed against the belt 7. If this transfers back to the rear surface of the paper, the rear surface of the paper will be contaminated.

Figure 2:
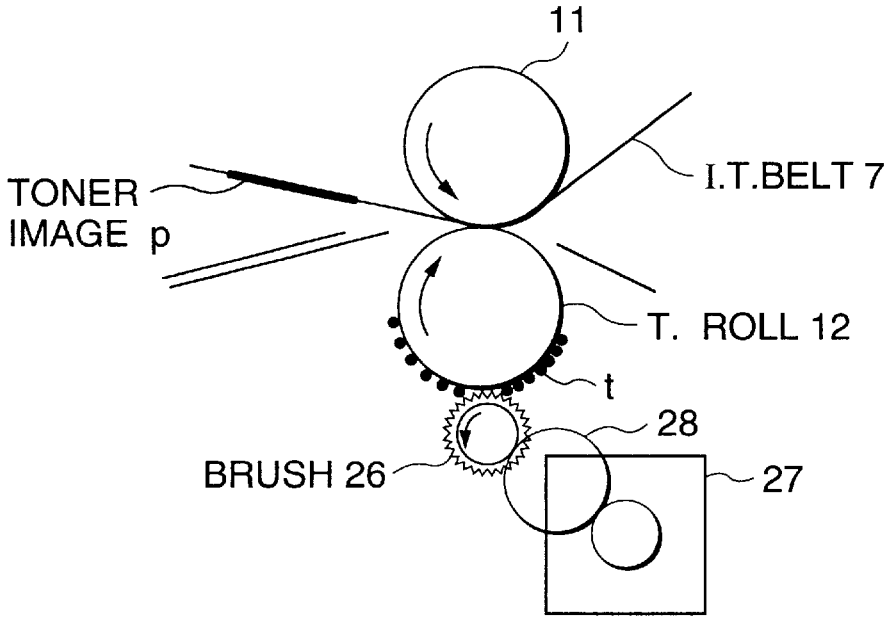
FIG. 2 is a side elevation of main portions of the image forming apparatus shown in FIG. 1.

Accordingly, the present embodiment adopts a structure as shown in FIG. 2, where a cylindrical brush 26 is located in contact with the transfer roll 12. This brush 26 is comprises a cylindrical core of a synthetic resin such as polycarbonate. The outer surface of the core is planted with insulating bristles or fibers of polypropylene or nylon. The bristles or fibers of the brush touch the transfer roll 12. The brush 26 may be planted with bristles or fibers variously. For instance, the outer surface of the brush may be uniformly or spirally planted with bristles or fibers.

Those bristles or fibers of the brush 26 which touch the transfer roll 12 have appropriate flexibility and their front ends touch the transfer roll 12 uniformly. For this purpose, the density of the bristles of the brush 26 is set to 30,000 to 60,000/inch$^2$ and the length of the bristles is 7±3 mm. The yarn is 17 denier per filament. The Young modulus is 330 to 1000 kg/cm$^2$.

A drive motor 27 is mounted around the brush 26. Driving force of this motor 27 is transmitted via a gear 28 to the brush 26 to rotate it in the direction of rotation (counterclockwise direction) of the transfer roll 12 or in a forward direction (counterclockwise direction) . Where the toner diffusion means and the transfer roll are rotated in the same direction, a lighter load is imposed on the transfer roll, producing desirable results. By appropriately setting the speed reduction ratio between the rotating speed of the motor 27 and the gear 28, the brush 26 rotates with a given peripheral speed difference with the transfer roll 12.

The speed difference between the transfer roll 12 and the brush 26 is now discussed. It is assumed that the transfer roll 12 rotates at a peripheral speed of 1. The brush 26 is designed to rotate at a peripheral speed of 1.5 to 2. The speed difference should be set by taking also the density of the bristles of the brush 26 into consideration such that the surface of the rotating transfer roll 12 can be uniformly touched by the tips of the bristles of the brush 26.

The rotating shaft of the transfer roll 12 is held by a bracket (not shown), which in turn interlocks with operation of an actuator (not shown) and moves the transfer roll 12 up and down. Thus, the transfer roll 12 is moved into and out of contact with the backup roll 11. Accordingly, in the present embodiment, the rotating shafts of the transfer roll 12 and brush 26 are held by the common bracket or fabricated as a unit. When the transfer roll 12 moves into and out of contact with the backup roll, the distance between the axes of the transfer roll 12 and the brush 26 and their positional relation are kept constant at all times. The subassembly of the transfer roll 12 and the brush 26 is easily detachably mounted to the body of the machine.

In the image forming apparatus constructed as described above, the brush 26 is mounted in contact with the transfer roll 12. This brush 26 rotates with a speed difference with the transfer roll 12. In consequence, the toner t adhering to the transfer roll 12 in the secondary transfer position P2 is stirred by the brush 26. In this way, the brush 26 diffuses the toner t on the surface of the transfer roll 12. For example, if a toner image p forming the process control patch touches the transfer roll 12 and consequently the toner adheres to the transfer roll 12, the sharp edges of the process control patch are decreased in concentration and thus removed. Furthermore, where toner adheres to the transfer roll 12 due to a difference in size between the toner image and the paper, the sharp edges are removed on the sample principle.

As a result, if the outer surface of the transfer roll 12 touches the rear surface of the paper, the rear surface is prevented from being contaminated to a visually observable level. The toner stirred by the brush 26 adheres to the rear surface of the paper. Besides, the toner is again transferred to the intermediate transfer belt 7, removed by the belt cleaner 15, and recovered. Therefore, it is not necessary to install a toner recovery box near the secondary transfer position P2.

The brush 26 performs a cleaning function. The transfer roll 12 is pressed against the backup roll 11 via the intermediate transfer belt 7. No paper is nipped between the intermediate transfer belt 7 and the transfer roll 12. Under this condition, a bias voltage that is opposite in polarity to the transfer bias voltage is applied to the transfer roll 12. The toner does not readily adhere to the transfer roll 12 from the intermediate transfer belt 7 in the secondary transfer position P2. This can further improve the cleaning capability of the transfer roll 12.

In the past, a blade is pushed against the transfer roll 12 to scrape the toner off. In the present embodiment, the front end of the brush 26 is brought into light contact with the transfer roll to stir the toner, unlike the prior art hard cleaning method described above. The toner is diffused on the transfer roll 12. As a result, no conspicuous contamination occurs on the rear surface of the paper. That is, a soft cleaning method is adopted. Hence, the transfer roll 12 is prevented from being damaged excessively. In this way, even if the transfer roll 12 ages, deterioration of its surface is minimized. The life can be prolonged.

Furthermore, peeling of the fluorocarbon coating on the surface of the transfer roll 12 can be prevented effectively. Therefore, the releasability of the paper can be maintained well for a long period. Since the powdered toner stirred by the brush 26 adheres to the surface of the transfer roll 12 uniformly and sparsely, the coating of fluorocarbon cooperates with the toner on the surface to improve the releasability further. As a result, paper jams around the transfer roll 12 can be prevented reliably for a long period.

In the prior art cleaning method using a blade, the blade pushes against the transfer roll 12, increasing the load on the transfer roll 12 greatly during rotation of the roll 12. Therefore, a driving power source for driving the transfer roll 12 is necessary independent of a driving power source such as an electric motor for driving the intermediate transfer roll 7. In the present embodiment, desired cleaning effect can be obtained simply by bringing the tips of the bristles of the brush 26 into light contact with the front surface of the transfer roll 12. Consequently, the load imposed on the rotating transfer roll 12 can be reduced greatly. This enables the driving power source driving the intermediate transfer belt 7 to rotate the transfer roll 12.

Power can be transmitted from the transfer roll 12 to the brush 26 or from the backup roll 11 to the brush 26 by mounting power-transmitting members such as gears, belts, pulleys, or the like to the rotating shafts of the transfer roll 12 and of the brush 26 or to the rotating shafts of the backup roll 11 and of the brush 26. In this case, the transfer roll 12 and the backup roll 11 rotate in response to movement of the intermediate transfer belt 7. A driving power source that drives the intermediate transfer belt 7 can also be used to rotate the brush 26. As a result, the mechanisms can be simplified. Also, the same driving power source can be shared between plural mechanisms.

In the embodiment described above, the brush 26 is rotated in the same direction as the rotation of the transfer roll 12 to reduce the load imposed on the rotating transfer roll 12 to a minimum. If the torque is not a great concern, the brush 26 may be rotated in a direction opposite to the direction of rotation of the transfer roll 12. In this case, the transfer roll 12 and the brush 26 make a great difference in peripheral speed and so if the density of the bristles or fibers of the brush 26 is low, the surface of the transfer roll 12 can be uniformly touched by the tips of the bristles of the brush 26.

A speed difference is produced between the rotating transfer roll 12 and the brush 26 that does not rotate and a desired object can be achieved simply by bringing the nonrotating brush 26 into contact with the surface of the rotating transfer roll 12. Therefore, it is not always necessary to rotate the brush 26. Furthermore, the brush is not always necessary to be shaped cylindrically. For example, the tips of the bristles of the brush may lie within a uniform plane or within a plane curved along the outer surface of the transfer roll 12. However, if one location of the brush is kept in contact with the transfer roll 12, then toner will be accumulated around the feet of the bristles of the brush, thus weakening the diffusion of the toner on the transfer roll 12. For this reason, the brush 26 is rotated as described above, or the brush is reciprocated circumferentially or tangentially of the transfer roll 12 to vary the location of the brush 26 in contact with the brush 26.

Figure 3:
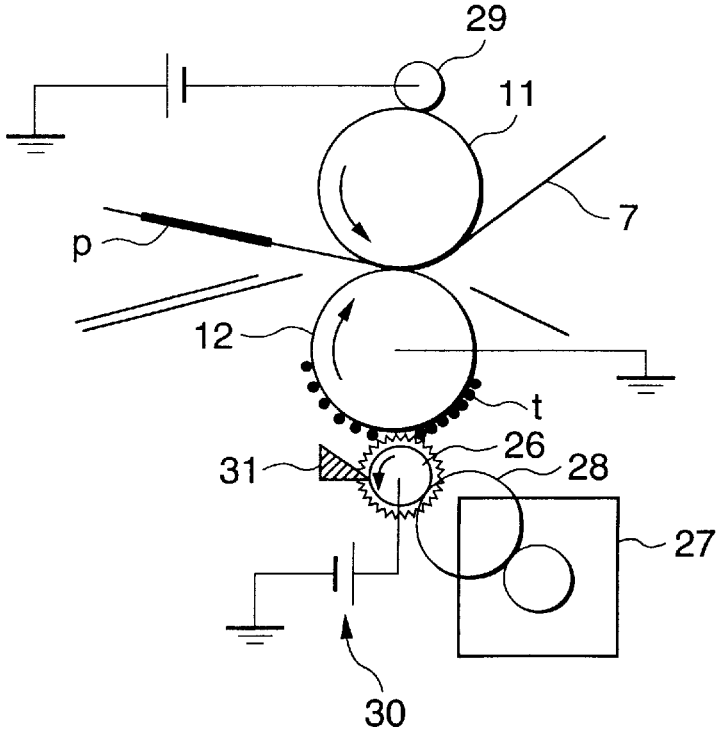
FIG. 3 is a fragmentary side elevation of a machine incorporating the image forming apparatus shown in FIG. 2.

FIG. 3 is a view illustrating parts of a machine using the image forming apparatus already described in connection with FIG. 2. In FIG. 3, a bias feed roll 29 is pressed against the backup roll 11. The transfer roll 12 is grounded. A bias application portion 30 for applying a bias voltage of a positive polarity opposite to the negative polarity of the toner is electrically connected with the cleaning brush 26. The bristles of the brush 26 are made of a conductive material having a resistance of $10^2$ to $10^4$ Ω•cm, e.g., nylon to which a conductive material is added. The yarn is 10 denier per filament. The Young modulus is 200 to 450 $kg/cm^2$. This material is used alone or mixed with bristles consisting of an insulating material.

An elongated flicker bar 31 that is a toner-removing member is mounted near the brush 26 and extends parallel to the axis of the brush. One end of the flicker bar 31 is in contact with the bristles over the whole width of the brush 26. The flicker bar 31 is mounted to a bracket (not shown) that supports the transfer roll 12 and the brush 26.

In this application, when the brush 26 cleans the transfer roll 12, the bias application portion 30 applies a bias voltage opposite in polarity to the charge given to the toner to the brush 26. Therefore, the toner on the transfer roll 12 easily adheres to the brush 26. The toner can be accepted to the brush 26 from the transfer roll 12 while stirring the toner adhering to the transfer roll 12. Consequently, the cleaning effect of the brush 26 can be enhanced.

Since the toner adhering to the brush 26 from the transfer roll 12 is removed by the flicker bar 31 in contact with the brush 26, the toner adhering to the brush 26 can be prevented from adhering back to the transfer roll 12. This can maintain the cleaning effect of the brush 26. Because the amount of toner removed by the flicker bar 31 is much smaller than the amount of toner immediately removed from the transfer roll using a blade by the prior art technique, even if a toner recovery box is installed, the box can be made very small. Therefore, the cleaning effect of the brush 26 can be enhanced. In addition, miniaturization of the mechanism around the secondary transfer position P2 and reduced cost can be accomplished simultaneously.

Figure 4:
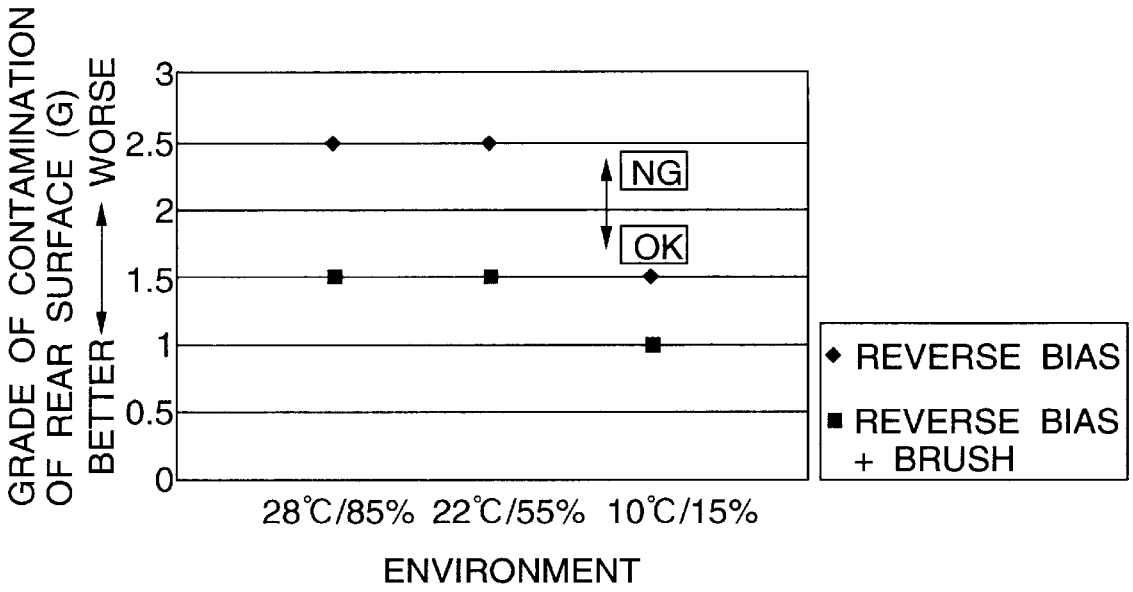
FIG. 4 is a graph illustrating one effect of a cleaning method in accordance with the invention.

Specific examples of improvement of cleaning in the present embodiment are now described. FIG. 4 shows the results of measurements of degree of contamination of the rear surface of paper where a reverse bias is applied to the transfer roll without using the brush 26 (indicated by "only reverse bias") under various environmental conditions (i.e., temperatures and humidities), as well as the results of measurements of degree of contamination of the rear surface of paper where a reverse bias is applied to the transfer roll and the brush 26 is brought into contact with the roll (indicated by "reverse bias+brush").

Three environmental conditions were used in FIG. 4. One condition is given by a high temperature of 28° C. and a high humidity of 85%. Another condition is given by an ordinary temperature of 22° C. and an ordinary humidity of 55%. A further condition is given by a low temperature of 10° C. and a low humidity of 15%. In the case of the reverse bias (prior art case) and in the case of the reverse bias+brush (in the present embodiment), the degree of contamination of the rear surface is designated by grade (G). Grade 0 means that no toner can be observed with a loupe. Grade 1 means that toner can be observed with a loupe. Grade 1.5 means that it is difficult to observe toner with the naked eye. Grade 2 means that the edges of the patch can be observed with the naked eye. Grade 2.5 means that the whole patch can be easily observed with the naked eye.

As can be seen from FIG. 4, where only the application of the reverse bias is used, the levels of contamination of the rear surface under the low-temperature, low-humidity condition and under the ordinary-temperature, ordinary-humidity condition are grade 1.5 and thus are acceptable. However, under the high-temperature, high-humidity environment and under the ordinary-temperature, ordinary humidity condition, the levels of contamination of the rear surface are grade 2.5 and thus not acceptable. In the case of the reverse bias+brush, the contamination of the rear surface under the low-temperature, low-humidity condition is grade 1. Under the high-temperature, high-humidity condition and under the ordinary-temperature, ordinary-humidity condition, the contamination of the rear surface is grade 1.5. In this way, the levels of contamination of the rear surface are acceptable under all environmental conditions.

Figure 5:
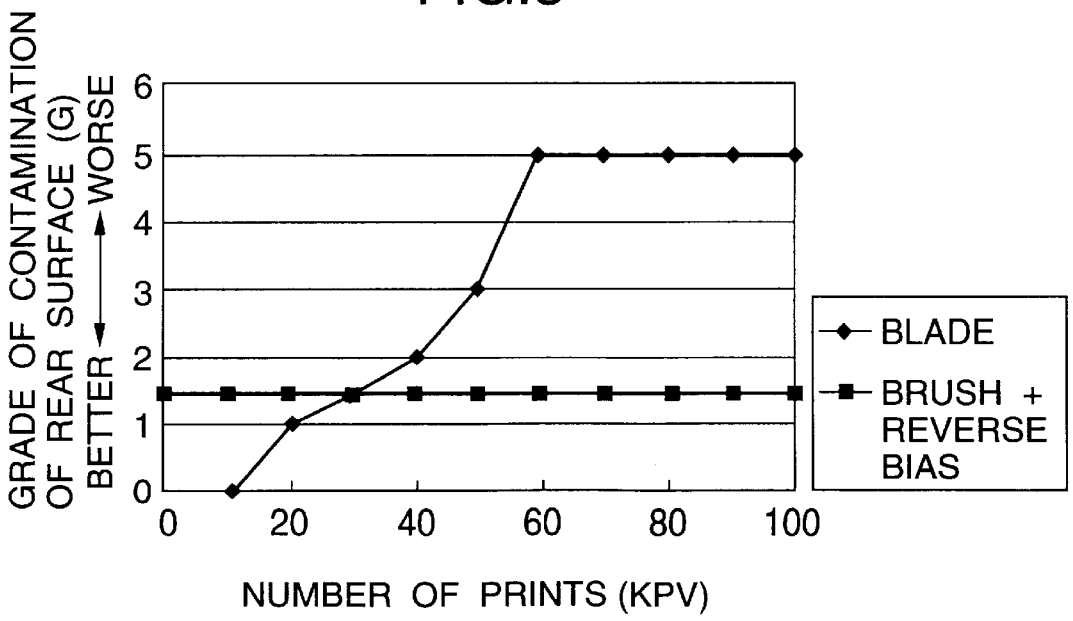
FIG. 5 is a graph illustrating another effect of a cleaning method in accordance with the invention.

FIG. 5 shows the result of measurements of the degree of contamination of the rear surface of paper. That is, the grade of contamination is plotted on the vertical axis, while the number of prints (KPV) is plotted on the horizontal axis for the case in which the blade is pressed against the transfer roll (in the case of blade) and cleaning is done and for the case in which a reverse bias is applied and the brush 26 is brought into contact with the roll (in the case of reverse bias+brush). The degree of contamination is indicated by grade (G), in the same way as in FIG. 4.

As can be seen from FIG. 5, in the case of blade, the grade of contamination of the rear surface is low where the number of prints is small, and good results are obtained. However, where the number of prints reaches 40 KPV, the contamination of the rear surface deteriorates to grade 2. Where the number of prints is 40 to 60 KPV, contamination of the rear surface quickly deteriorates from grade 2 to grade 5. Subsequently, grade 5 is maintained. On the other hand, in the case of reverse bias+brush, where the number of prints is as small as less than 20 KPV, the contamination of the rear surface is at a higher grade than in the case of blade. However, the contamination level is suppressed to grade 1.5, which cannot be visually observed. If the number of prints increases to 40 KPV, 60 KPV, 80 KPV, and so on, the contamination of the rear surface is kept at grade 1.5, which presents no problems.

As can be seen from the results described above, the use of the structure in accordance with the present invention is very effective in preventing contamination of the rear surface of the paper.

Figure 6:
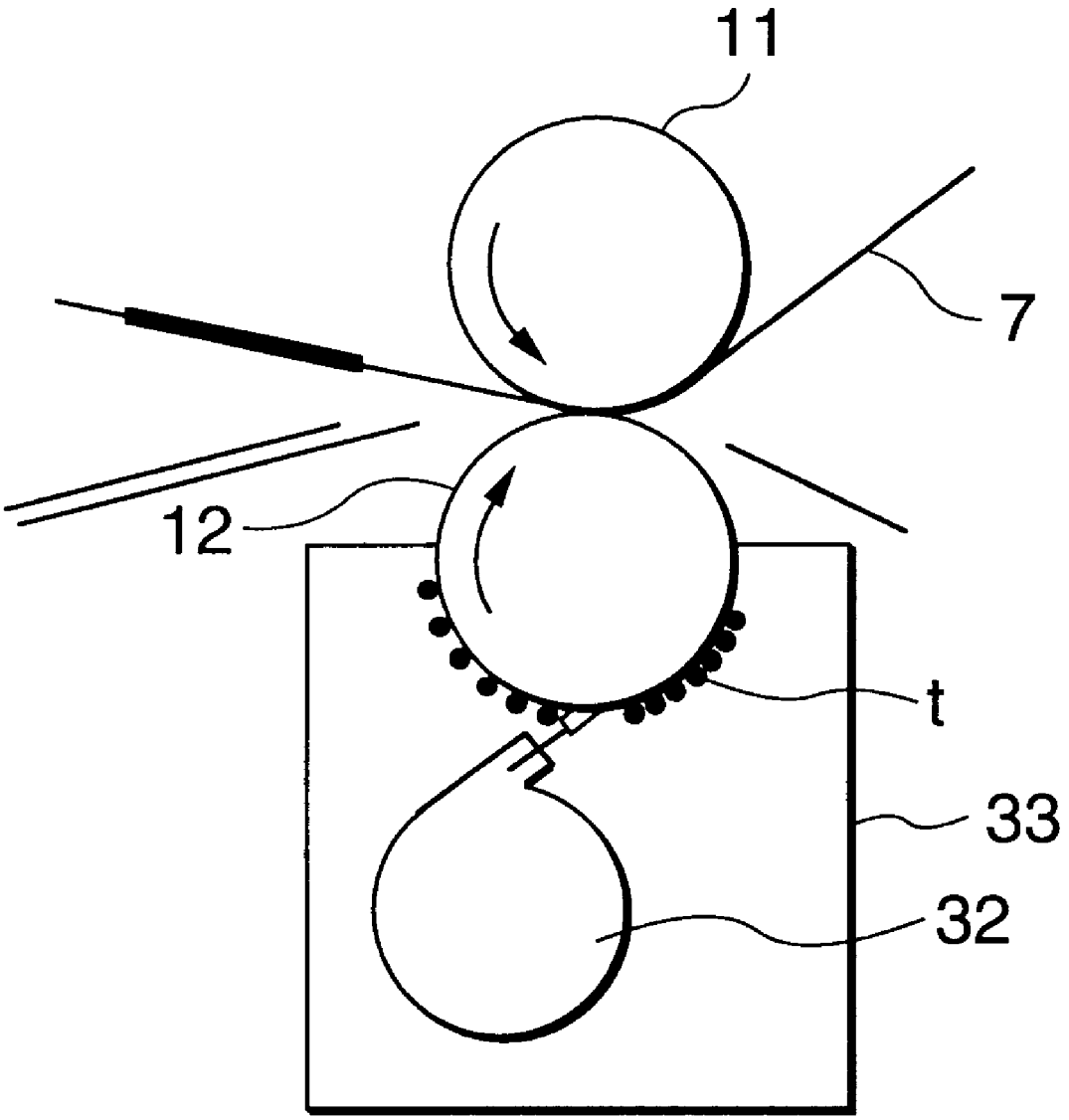
FIG. 6 is a view similar to FIG. 2, but showing another image forming apparatus in accordance with the invention.

In the embodiment described above, the transfer roll is pressed against the intermediate transfer belt 7 to stir the toner adhering to the transfer roll 12 by the brush 26. It is to be understood that the present invention is not limited to this scheme. For example, as shown in FIG. 6, a blower fan 32 may be mounted near the transfer roll 12. This blower fan 32 blows air against the transfer roll 12, thus stirring the toner t adhering to the transfer roll 12. In this case, it is desired to surround the blower fan 32 and the transfer roll 12 partially with a housing 33; otherwise, the toner t adhering to the transfer roll 12 would be splashed about due to blowing air.

In the embodiment described above, the transfer roll has been described. It is to be noted that the present invention is not limited to this structure. Any transfer means may be adopted as long as it can transfer toner images on an image carrier including a transfer belt to paper.

In the image forming apparatus in accordance with the embodiment described above, toner images of various colors are formed on one photoconductor drum 1 in turn. These toner images are transferred to the intermediate transfer belt 7 in turn to obtain a color image. The invention is also applicable to other structures. One example is a 4-tandem image forming apparatus equipped with image-forming units for different colors, respectively. Each image-forming unit comprises a photoconductor drum and peripheral devices. Another example is a 2-tandem image forming apparatus comprising two independent image formation units. Two colors are assigned to each unit. A further example is a monochrome image forming apparatus using an image-carrying belt that carries a toner image. Paper (recording medium) is nipped between the belt and the transfer roll. The toner image is transferred to the paper. This is one kind of intermediate transfer method.

In the embodiment described above, an image-carrying belt has been described. The image carrier of the present invention is not limited to this. The image carrier may include a photoconductor.

As described thus far, the image forming apparatus in accordance with the present invention is equipped with a toner diffusion means for stirring toner adhering to the transfer roll. Contamination of the rear surface of paper can be effectively prevented while suppressing deterioration of the surface of the transfer roll by stirring and diffusing the toner adhering to the transfer roll by the toner diffusion means. In the past, toner has been removed from the surface of the transfer roll using a blade.

What is claimed is:

1. An image forming apparatus comprising:

an image carrier for carrying a toner image visualized by a toner;

a transfer device mounted in contact with said image carrier and acting to transfer the toner image carried on said image carrier to a recording medium; and a toner diffusion member for stirring the toner adhering to said transfer device by making contact with said transfer device.

2. The image forming apparatus of claim 1, further comprising a means for applying a bias voltage that is opposite in polarity to a transfer bias voltage of said transfer device.

3. The image forming apparatus of claim 1, wherein said toner diffusion member is rotatable.

4. The image forming apparatus of claim 1, wherein said toner diffusion member is mounted in contact with said transfer device, and wherein there is further provided a means for applying a bias voltage that is opposite in polarity to electric charge given to said toner to said toner diffusion member.

5. The image forming apparatus of claim 3, wherein said toner diffusion member rotates at a different speed than said transfer device.

6. The image forming apparatus of claim 3, further comprising a power source for driving said transfer device, thus rotating said toner diffusion member.

7. The image forming apparatus of claim 1, further comprising a toner-removing member for removing the toner adhering to said toner diffusion member by making contact with said toner diffusion member.

8. An image forming apparatus comprising:

an image carrier for carrying a toner image visualized by a toner;

a transfer device mounted in contact with said image carrier and acting to transfer the toner image carried on said image carrier to a recording medium; and a toner diffusion member for diffusing the toner adhering to said transfer device over a wide area and reducing its concentration by making contact with said transfer device.

9. The image forming apparatus of claim 1, wherein said transfer device and said toner diffusion member are made of a common member.

10. The image forming apparatus of claim 9, wherein said transfer device and said toner diffusion member are fabricated as a unit and detachably mounted to a main body of said image forming apparatus.

11. The image forming apparatus of claim 1, wherein said toner diffusion member is a brush.

12. The image forming apparatus of claim 3, wherein said toner diffusion member rotates in the same direction as direction of rotation of said transfer device.

* * * * *